US006098607A

United States Patent [19]

Strother

[11] Patent Number: 6,098,607

[45] Date of Patent: Aug. 8, 2000

[54] FORCE-MULTIPLYING COMPOUND BOW

[76] Inventor: Kevin D. Strother, P. O. Box 658, Springhill, La. 71075

[21] Appl. No.: 09/404,969

[22] Filed: Sep. 24, 1999

Related U.S. Application Data

[60] Provisional application No. 60/122,209, Mar. 1, 1999, and provisional application No. 60/122,210, Mar. 1, 1999.

[51] Int. Cl.[7] ..... F41B 5/10

[52] U.S. Cl. ..... 124/25.6

[58] Field of Search ..... 124/25.6, 900

[56] References Cited

U.S. PATENT DOCUMENTS

| | | | |
|---|---|---|---|
| 4,103,667 | 8/1978 | Shepley . | |
| 4,562,824 | 1/1986 | Jennings . | |
| 4,683,865 | 8/1987 | Troncoso | 124/25.6 |
| 4,718,397 | 1/1988 | Remick | 124/25.6 |
| 4,971,020 | 11/1990 | Soderstrom et al. | 124/25.6 X |

*Primary Examiner*—John A. Ricci
*Attorney, Agent, or Firm*—David S. Alavi

[57] ABSTRACT

A compound archery bow comprises: a) a central handle portion having oppositely extending upper and lower bow limbs substantially secured thereto; b) a draw cable; c) an upper let-out/take-up cable; d) a lower let-out/take-up cable; e) a power cable secured to an upper end of the upper bow limb; f) an upper pulley assembly rotatably mounted on the upper bow limb at the upper end thereof for letting out an upper end of the draw cable and taking up an upper end of the upper let-out/take-up cable as the bow is drawn; g) a lower pulley assembly rotatably mounted on the lower bow limb at a lower end thereof and comprising a base cam for letting out a lower end of the draw string as the bow is drawn, d let-out/take-up cam for letting out a lower end of the lower let-out/take-up cable as the bow is drawn, and a power cam for taking up a lower end of the power cable as the bow is drawn; h) a bracket substantially secured to the handle; and i) a middle pulley rotatably mounted on the bracket for letting out a lower end of the upper let-out/take-up cable and taking up an upper end of the lower let-out/take-up cable as the bow is drawn. The middle pulley may be provided with an eccentric weight. The weight should preferably be positioned to dampen vibration, reduce recoil, and/or reduce noise generated by the bow during a shot.

25 Claims, 15 Drawing Sheets

FORCE-MULTIPLYING COMPOUND BOW

RELATED APPLICATIONS

This application claims benefit of prior filed co-pending provisional application Ser. No. 60/122,209, filed Mar. 1, 1999, said application being hereby incorporated by reference as if fully set forth herein. This application also claims benefit of prior filed co-pending provisional application Ser. No. 60/122,210, filed Mar. 1, 1999, said application being hereby incorporated by reference as if fully set forth herein.

FIELD OF THE INVENTION

The field of the present invention generally relates to archery bows, and in particular compound archery bows. Specifically, a compound archery bow is disclosed herein having a force multiplier comprising a middle pulley.

BACKGROUND

Solo or single-cam compound bows are well known in the art. A plurality of these have been previously disclosed, some of which are described in U.S. Pat. Nos. 5,505,185 and 5,368,006, each of said patents being incorporated by reference as if fully set forth herein. Dual-cam compound bows are also well known in the art, some of which are described in U.S. Pat. Nos. 4,739,744 and 5,040,520, each of said patents being incorporated by reference as if fully set forth herein, and in which are described in detail the mechanics of a compound bow including non-circular dual cam members which impart dynamic forces on the bow limbs.

Whether single-cam or dual-cam, the purposes and advantages of compound bows are well known to those skilled in the art and need not be repeated herein. Compound bows typically comprise: a handle from which resilient bow limbs extend oppositely; pulley means comprising cams, levers, and/or pulleys and typically being disposed at the tips of the limbs of the bow; and one or more cables coupled to the bow limbs and/or pulley means to give assorted mechanical advantages. One important characteristic of compound bows is the "let-off" (i.e., an abrupt decrease) of the draw force at the end of the draw, thereby allowing an archer to more readily maintain the bow in a fully drawn position while accurately aiming the arrow and/or waiting for game to pass within shot.

When a bow is drawn potential energy is stored in the bow limbs which are deflected substantially equally when the bow string (or draw cable) is drawn. Stored potential energy may be calculated from the draw force as a function of draw distance. Potential energy is converted to kinetic energy when the archer releases the drawn bow with the arrow placed on the draw cable, thereby allowing the bow limbs to return to their resting position and propelling the arrow. Kinetic energy may be calculated from the speed and mass of the arrow, which may in turn allow the efficiency (i.e., the fraction of potential energy converted to kinetic energy) of the bow to be calculated. It is well accepted in the industry and within the sport that efficiency is critical to bow performance: the more efficient a bow the faster the bow will propel an arrow of given weight for a given draw length and given peak draw force. Previous compound bows, single- or dual-cam, have AMO standard efficiencies of approximately 70–81% (see Table 2 on page 80 of "Bowhunting World, August, 1995, which is incorporated by reference as though fully set forth herein; see Table 2 on page 68 of "Bowhunting World" December, 1996, which is incorporated by reference as if fully set forth herein; see FIG. 3 on page 62 of "Bowhunting World" April, 1997, which is incorporated by reference as if fully set forth herein; and see Table 2, Bowhunting Buyers Guide, 1997, which is incorporated by reference as if fully set forth herein). A number of bow characteristics impact the efficiency of a bow, but many of these are well known in the art and therefore need not be repeated herein.

However, the advantages of let-off and energy storage come at the price of a relatively complicated set of cable and pulleys as part of the bow. One particular problem caused by this complex system is that of "nock travel". (The nock point is the point on the draw cable where the end of the arrow is fitted for shooting.) Ideally, the nock point should move straight back as the bow is drawn. Any deviation of the nock point upward or downward as the bow is drawn is called nock travel, and is highly undesirable. Nock travel may affect the accuracy of the bow, the efficiency of the bow, or both.

It is therefore generally desirable to provide a compound archery bow having desirable performance characteristics, which may include but are not limited to: peak draw weight, draw length, draw weight profile, stored energy, efficiency, arrow speed, let-off, recoil, vibration, noise, and/or nock travel. In particular, a compound bow having a force-multiplying middle pulley may improve peak draw weight, draw length, draw weight profile, stored energy, efficiency, arrow speed, and/or let-off characteristics of the bow while reducing and/or eliminating nock travel.

SUMMARY

Certain aspects of the present invention may overcome one or more aforementioned drawbacks of the previous art and/or advance the state-of-the-art of compound archery bows, and in addition may meet one or more of the following objects:

To provide a compound archery bow having a force multiplier comprising a middle pulley;

To provide a compound archery bow having a force multiplier comprising a middle pulley for letting out an upper let-out/take-up cable and for taking up a lower let-out/take-up cable;

To provide a compound archery bow having a force multiplier comprising a middle pulley rotatably mounted on a bracket substantially secured to a central handle portion of a compound archery bow;

To provide a compound archery bow wherein the force multiplier may be used with any one of a variety of cam assemblies on a bow limb tip;

To provide a compound archery bow with a force multiplier which increases the energy stored by the drawn bow over the energy stored by the same bow without the force multiplier;

To provide a compound archery bow with a force multiplier which increases the energy stored by the drawn bow over the energy stored by the same bow without the force multiplier without substantially increasing the peak draw weight of the bow;

To provide a compound archery bow with a force multiplier which increases the speed of the bow 6 to 14 feet/second over the speed of the same bow without the force multiplier;

To provide a compound archery bow with a force multiplier which increases the speed of the bow 6 to 14 feet/second over the speed of the same bow without the force multiplier without substantially increasing the peak draw weight of the bow;

To provide a compound archery bow wherein the nock travel is controlled in part by the middle pulley;

To provide a compound archery bow wherein the peak draw weight is controlled in part by the middle pulley;

To provide a compound archery bow wherein the draw length is controlled in part by the middle pulley;

To provide a compound archery bow wherein the draw weight profile is controlled in part by the middle pulley;

To provide a compound archery bow wherein the stored energy is controlled in part by the middle pulley;

To provide a compound archery bow wherein the efficiency is controlled in part by the middle pulley;

To provide a compound archery bow wherein the arrow speed is controlled in part by the middle pulley;

To provide a compound archery bow wherein the let-off of the draw weight at full draw is controlled in part by the middle pulley; and To provide a compound archery bow wherein an eccentrically weighted middle pulley may dampen vibration, reduce recoil, and/or reduce noise generated by the bow during a shot.

One or more of the foregoing objects may be achieved in the present invention by a compound archery bow comprising: a) a central handle portion having oppositely extending upper and lower bow limbs substantially secured thereto; b) a draw cable; c) an upper let-out/take-up cable; d) a lower let-out/take-up cable; e) a power cable secured to an upper end of the upper bow limb; f) an upper pulley assembly rotatably mounted on the upper bow limb at the upper end thereof for letting out an upper end of the draw cable and taking up an upper end of the upper let-out/take-up cable as the bow is drawn; g) a lower pulley assembly rotatably mounted on the lower bow limb at a lower end thereof and comprising a base cam for letting out a lower end of the draw string as the bow is drawn, let-out/take-up means for letting out a lower end of the lower let-out/take-up cable as the bow is drawn, and a power cam for taking up a lower end of the power cable as the bow is drawn; h) a bracket substantially secured to the handle; and i) a middle pulley rotatably mounted on the bracket for letting out a lower end of the upper let-out/take-up cable and taking up an upper end of the lower let-out/take-up cable as the bow is drawn. The middle pulley may be provided with an eccentric weight. The weight should preferably be positioned to dampen vibration, reduce recoil, and/or reduce noise generated by the bow during a shot.

Additional objects and advantages of the present invention may become apparent upon referring to the preferred and alternative embodiments of the present invention as illustrated in the drawings and described in the following written description and/or claims.

Most of the Figures appear in pairs (A and B) and show side views of a compound archery bow according to the present invention, or substructures thereof, in the configuration prior to drawing the bow (A) and after drawing the bow (B). All such side views (A and B) are shown as viewed from the right side (the archer's right) of a right-handed bow. Several Figures include a back view (C) of a bow substructure prior to drawing the bow. Several Figures include a side view (D) as seen from the left side (the archer's left) of a right-handed bow prior to drawing the bow.

DETAILED DESCRIPTION OF PREFERRED AND ALTERNATIVE EMBODIMENTS

For purposes of the present written description and/or claims, the terms "upper" and "lower" shall have their usual definitions when referring to an archery bow, bow limbs, cables and ends thereof, and the like. It should be noted, however, that the entire bow may be inverted (interchanging top/upper and bottom/lower throughout) without departing from inventive concepts disclosed and/or claimed herein. For purposes of the present written description and/or claims, the terms "front", "forward", "back", "backward", "behind", and so on shall have their usual definitions when referring to an archery bow, bow limbs, pulleys, and the like, with the forward direction being the direction of arrow flight.

For purposes of the present written description and/or claims, each pulley, pulley assembly, and cam referred to herein has a rotation axis substantially perpendicular thereto, and at least one peripheral groove for receiving a corresponding cable. For purposes of the present written description and/or claims, rotations referred to in the text as "clockwise" or "counter-clockwise" are defined relative to the right side views (A and B) as shown in the Figures.

Figures and descriptions set forth herein primarily apply to a right-handed archery bow, but a left-handed archery bow employing substantially equivalent structures and/or having substantially equivalent functions shall fall within the scope of inventive concepts disclosed and/or claimed herein.

A force multiplier for a compound archery bow according to the present invention may be employed with any compound archery bow. The general construction of such a compound archery bow may be substantially the same as previous compound bows described in U.S. Pat. Nos. 5,505,185 and 5,368,006, each of said patents having been incorporated by reference hereinabove. The force multiplier may also be implemented as part of a compound archery bow constructed in the manner shown in U.S. Pat. No. 5,975,067, which is hereby incorporated by reference as if wholly set forth herein.

Figure 1B:
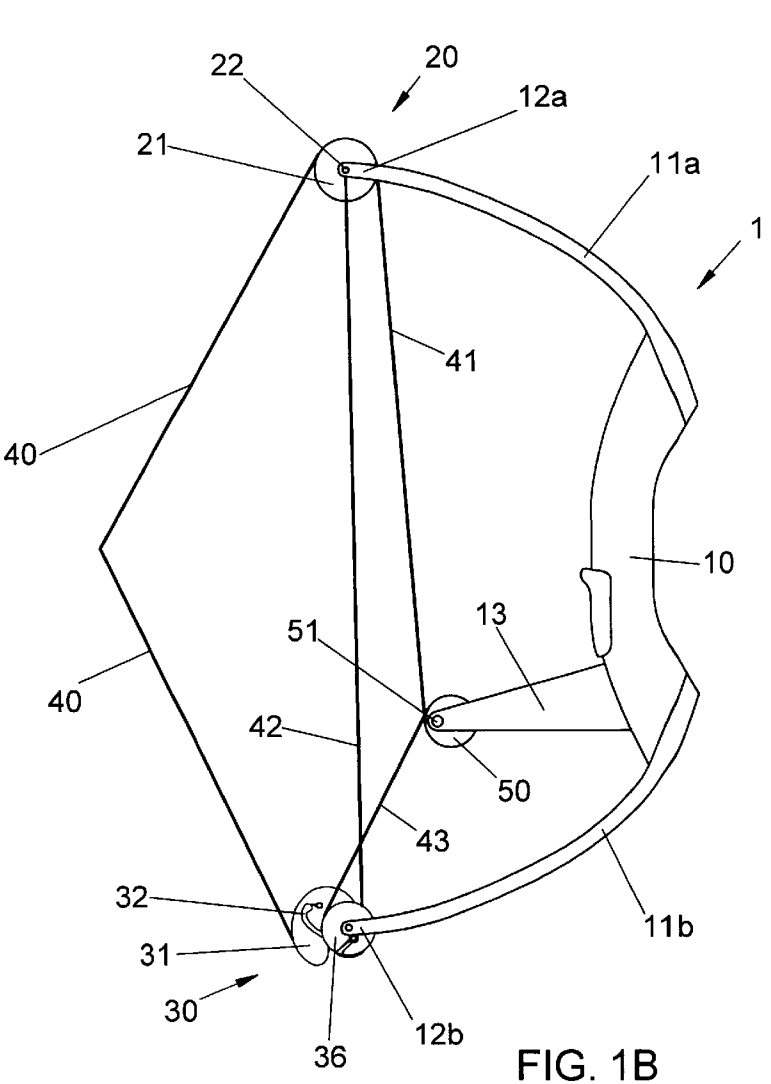
FIGS. 1A and 1B show a compound archery bow having a force-multiplying middle pulley according to the present invention.
Figure 1A:
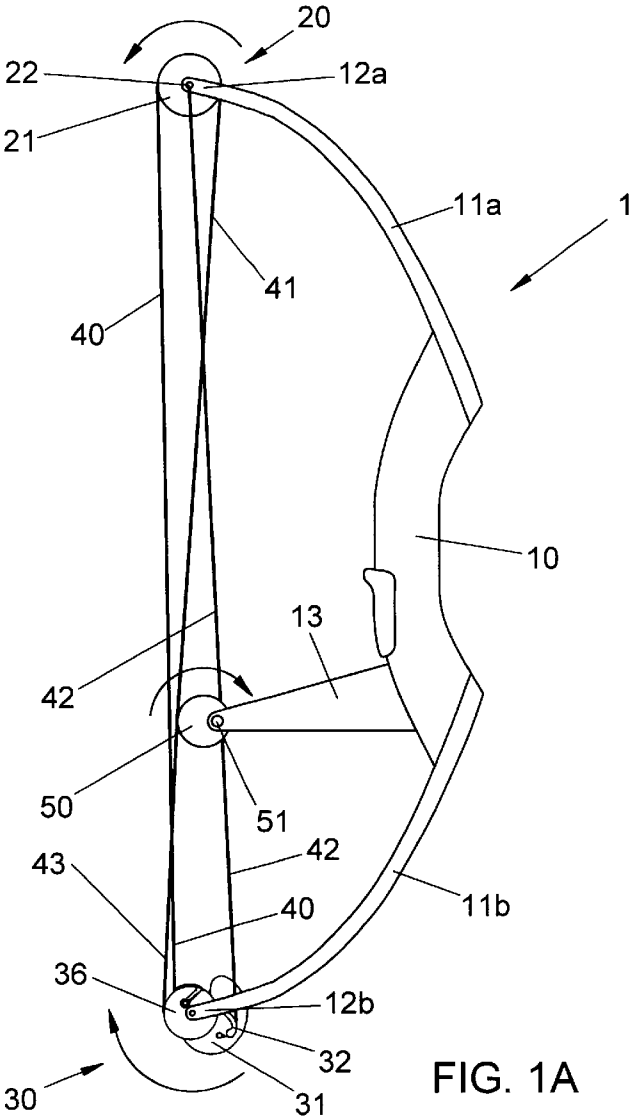
Figure 2C:
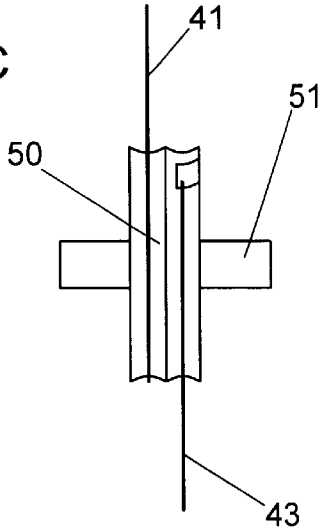
FIGS. 2A, 2B, 2C, and 2D show a force-multiplying middle pulley for a compound archery bow according to the present invention.
Figure 2D:
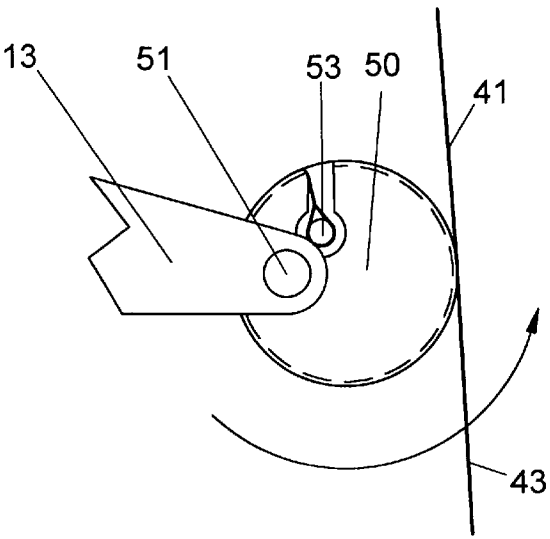
Figure 2A:
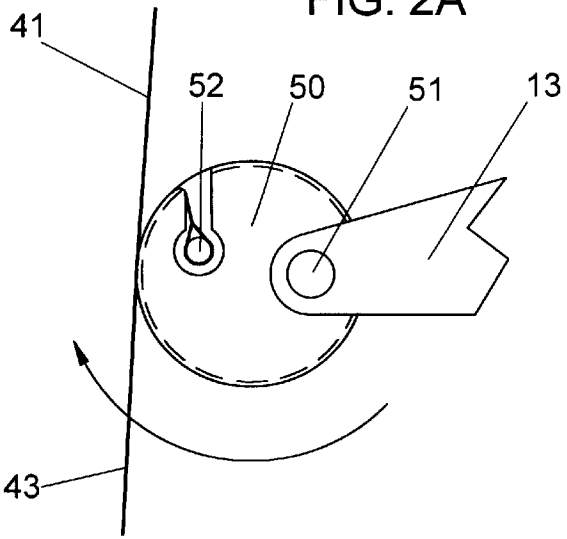
Figure 2B:
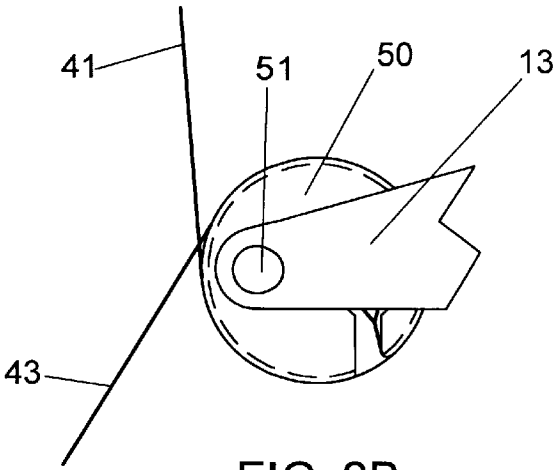

FIGS. 1A and 1B shows a compound archery bow 1, which includes a central handle portion 10. Resilient bow limbs 11*a* and 11*b* extend oppositely from the handle portion 10, including respective bow limb tips 12*a* and 12*b*, which preferably bifurcate at their ends thereby enabling the top and bottom pulley assemblies to be rotatably mounted therebetween. The specific configuration and/or arrangement of the central handle portion 10, the bow limbs 11*a* and 11*b*, and bow limb tips 12*a* and 12*b* may differ from those illustrated and described without departing from inventive concepts disclosed and/or claimed herein.

In a preferred embodiment of the present invention the compound bow assembly includes a top pulley assembly 20 comprising a substantially circular idler wheel 21 rotatably mounted to bow limb tip 12*a* by any of a number of means well known in the art. Idler wheel 21 may include a centrally disposed axle 22 which may be employed to rotatably mount idler wheel 21 to bow limb tip 12*a*. A groove or track may be provided on the periphery of idler wheel 21 in which may be received draw cable 40 and upper let-out/take-up cable 41. Draw cable 40 and upper let-out/take-up cable 41 may preferably be contiguous and may pass around idler wheel 21. When draw cable 40 is drawn idler wheel 20 rotates in a counter-clockwise direction (as shown in FIGS. 1A and 1B) and upper let-out/take-up cable 41 is taken up by wheel 21 as draw cable 40 is let out by wheel 21. The reverse occurs when draw cable 40 is released. An upper end of power cable 42 is secured to upper bow limb tip 12*a*.

Upper let-out/take-up cable 41 is secured at a lower end to middle pulley 50 (shown enlarged in FIGS. 2A through 2D), which may include an eccentrically disposed axle 51 which may be employed to rotatably mount middle pulley 50 on bracket 13. Bracket 13 may in turn be substantially rigidly secured to handle 10. An upper end of lower let-out/take up cable 43 may also be secured to middle pulley 50. Middle pulley 50 may be provided with one or more peripheral grooves for receiving upper and lower let-out/take-up cables 41 and 43, respectively. The upper end of lower let-out/take-up cable 43 may be secured to middle pulley by post 52, and the lower end of upper let-out/take-up cable 41 may be similarly secured to post 53 on middle pulley 50. Alternatively, any suitable means may be employed to secure upper and lower let-out/take up cables 41 and 43 to middle pulley 50. As the bow is drawn, clockwise rotation (as viewed from the right side of the bow) of middle pulley 50 results in upper let-out/take-up cable 41 being let out of middle pulley 50, while lower let-out/take-up cable 43 is taken up by middle pulley 50.

Figure 3B:
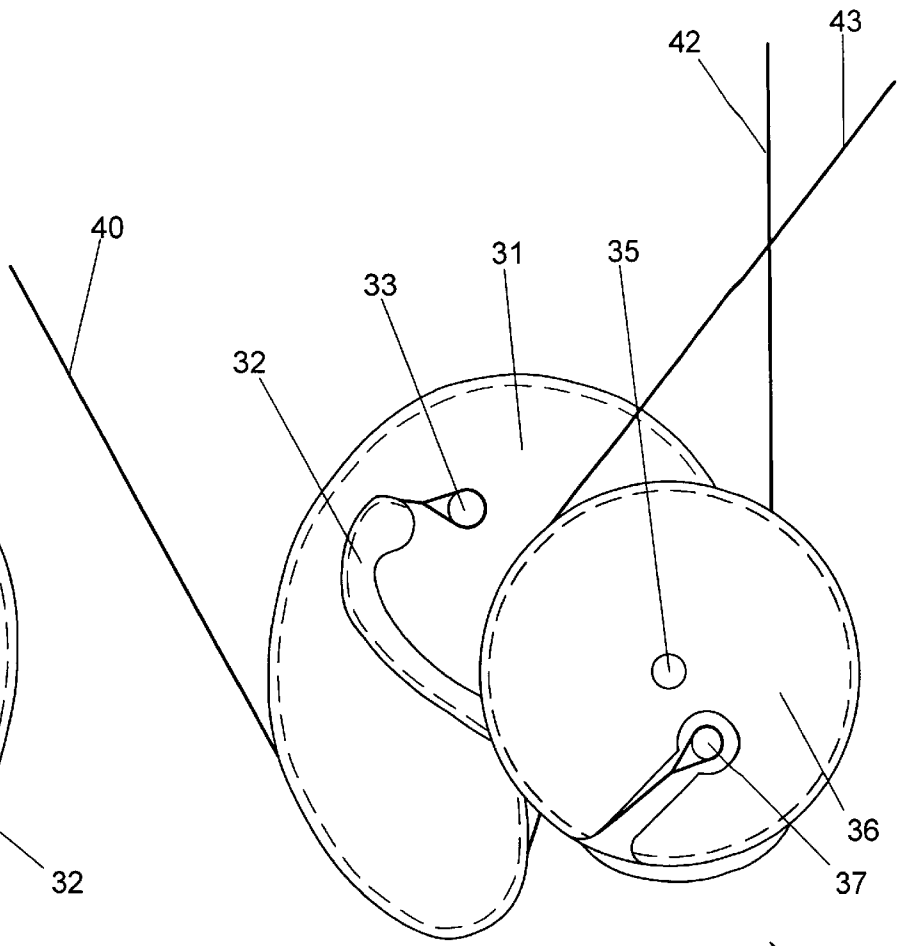
FIGS. 3A and 3B show a lower pulley assembly for a compound archery bow.
Figure 3A:
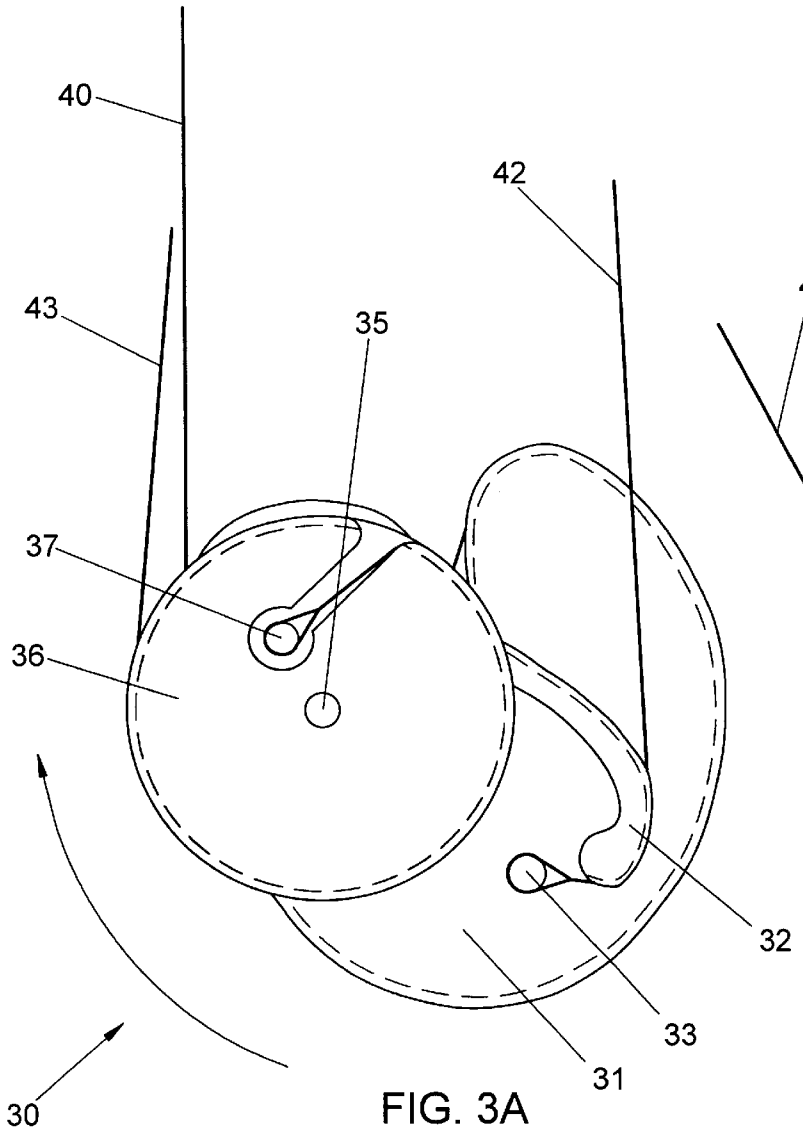

Draw cable 40 is secured at a lower end to bottom pulley assembly 30, shown enlarged in FIGS. 3A and 3B. Lower let-out/take-up cable 43 and power cable 42 are also secured at their respective lower ends to bottom pulley assembly 30. Bottom pulley assembly 30 (alternatively, base cam/power cam assembly 30) preferably comprises base cam 31, power cam 32, let-out/take-up cam 36, and associated mounting means and cable attachment means. Base cam 31 may be provided with a peripheral groove or track in which draw cable 40 may be received as it passes around base cam 31 and is secured thereto by means of a post (not shown). Without departing from inventive concepts disclosed and/or claimed herein, any suitable means may be employed to secure draw cable 40 to base cam 31. Base cam 31 includes a preferably eccentrically disposed axle 35 which may be employed to rotatably mount base cam 31 to bow limb tip 12*b* by any of various suitable means. As the bow is drawn and bottom pulley assembly 30 rotates in a clockwise direction (as viewed from the right side of the bow), draw cable 40 is let out of the peripheral groove of base cam 31.

In a preferred embodiment of the present invention the base cam/power cam assembly 30 may include a power cam 32 and a let-out/take-up cam 36. The lower end of power cable 42 may be received within a peripheral groove of power cam 32 and secured to base cam/power cam assembly 30 by post 33. Without departing from inventive concepts disclosed and/or claimed herein, any suitable means may be employed to secure power cable 42 to base cam/power cam assembly 30. As the bow is drawn and base cam/power cam assembly 30 rotates clockwise (as viewed from the right side of the bow), power cable 42 may be taken up within the peripheral groove of power cam 32, thereby deflecting the bow limb tips 12*a* and 12*b* toward each other and storing potential energy in the bow. The upper end of power cable 42 is preferably secured to bow limb tip 12*a*. A bifurcated yoke design for the upper end of power cable 42 (not shown), well known in the art, may be employed to secure the upper end of power cable 42 to axle 22 of the top pulley assembly 20. Without departing from inventive concepts disclosed and/or claimed herein, any functionally equivalent means may be employed to secure the power cable end to bow limb tip 12*a*. The lower end of lower let-out/take-up cable 43 may be received within a peripheral groove of let-out/take-up cam 36 and secured to base cam/power cam assembly 30 by post 37. Without departing from inventive concepts disclosed and/or claimed herein, any suitable means may be employed to secure lower let-out/take-up cable 43 to base cam/power cam assembly 30. As the bow is drawn and base cam/power cam assembly 30 rotates clockwise (as viewed from the right side of the bow), lower let-out/take-up cable 43 may be let out from the peripheral groove of let-out/take-up cam 36.

Figure 4B:
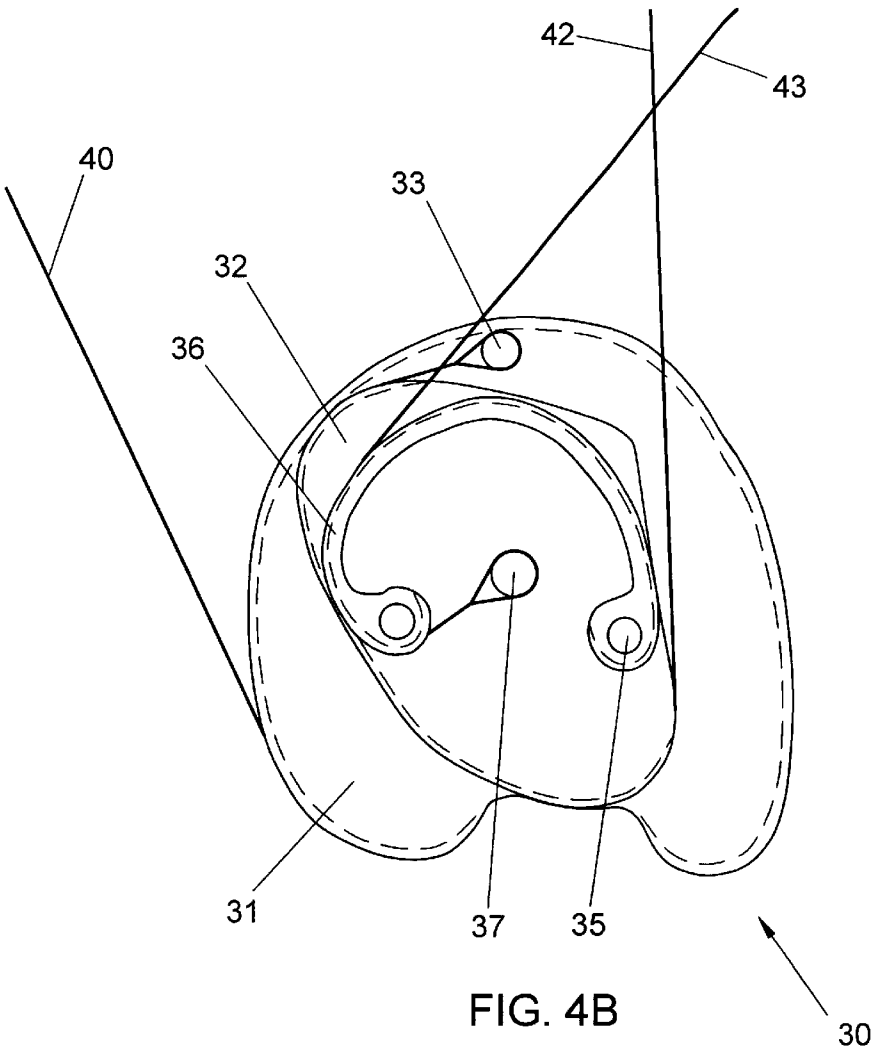
FIGS. 4A and 4B show a lower pulley assembly for a compound archery bow.
Figure 4A:
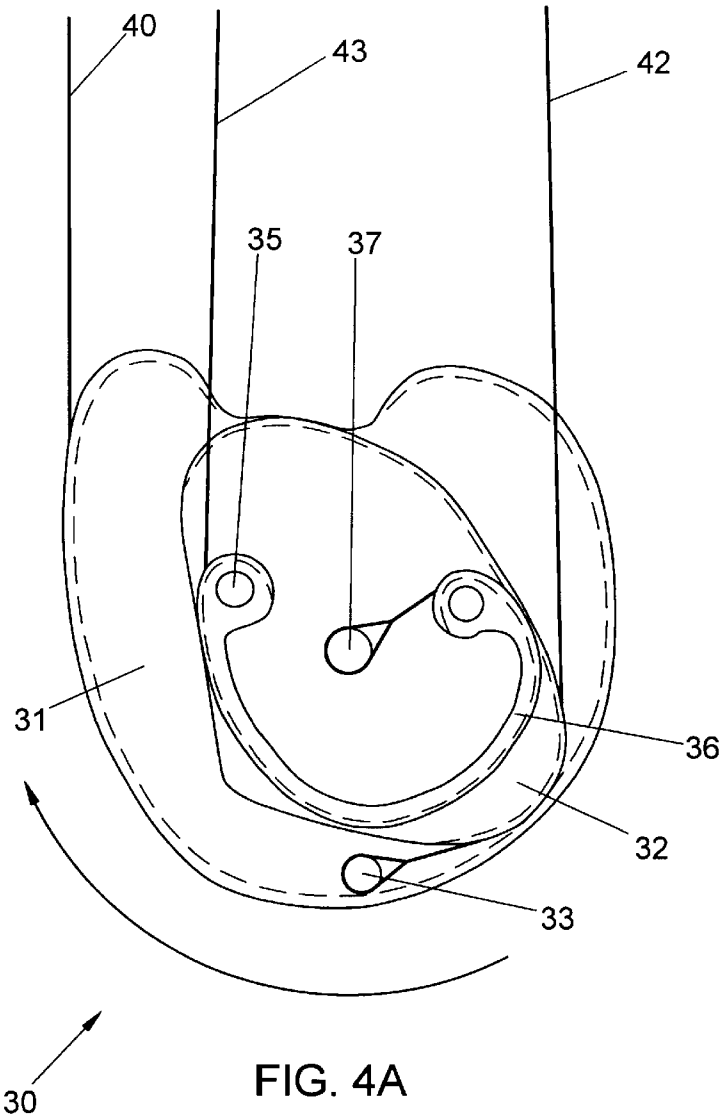
Figure 5B:
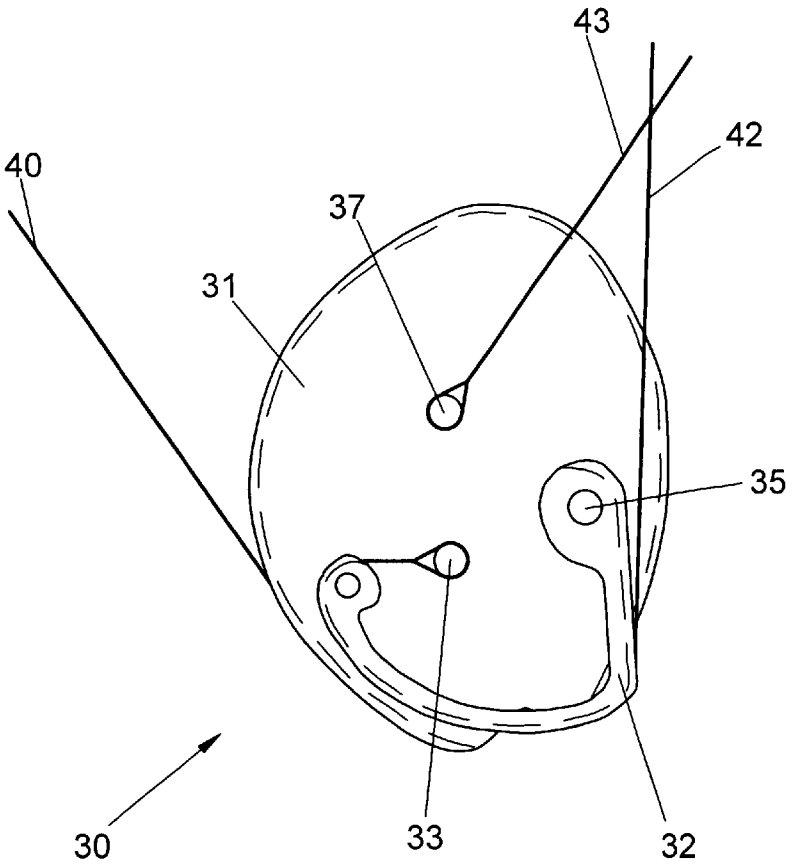
FIGS. 5A and 5B show a lower pulley assembly for a compound archery bow.
Figure 5A:
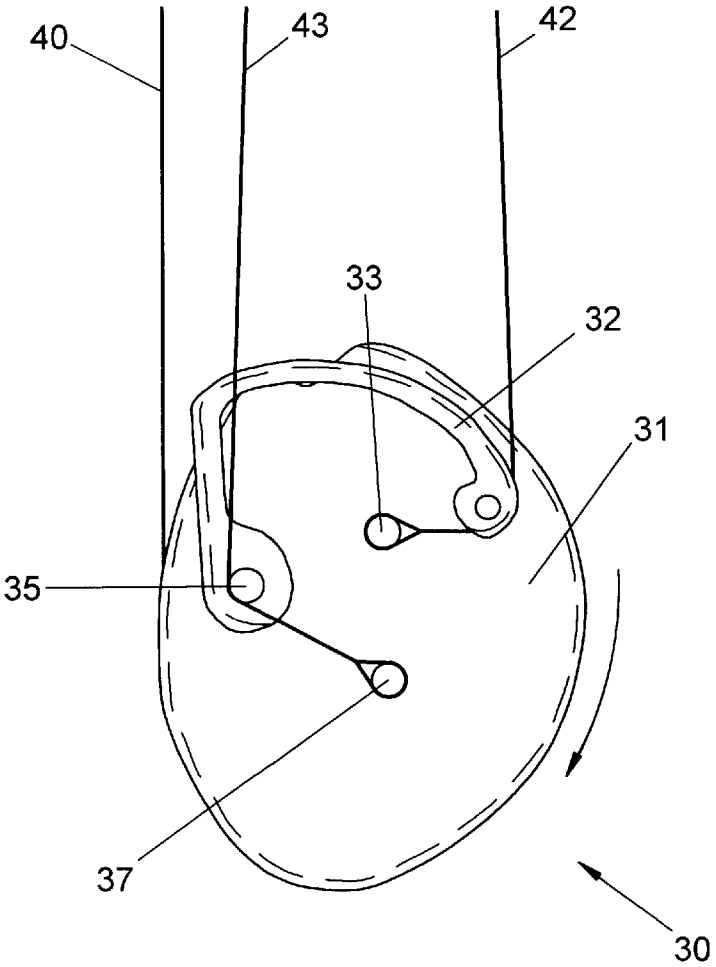

Alternative base cam/power cam assemblies 30 are illustrated in FIGS. 4A and 4B and in FIGS. 5A and 5B. The assembly 30 of FIGS. 4A and 4B differ from that of FIGS. 3A and 3B with respect to the sizes, positions, and shapes of base cam 31, power cam 32, and let-out/take-up cam 36. In particular, let-out/take-up cam 36 is a concentrically mounted, substantially circular pulley in the embodiment of FIGS. 3A and 3B, whereas it is an oblong, eccentrically mounted cam in the embodiment of FIGS. 4A and 4B. FIGS. 5A and 5B illustrate a substantially different scheme for letting out lower let-out/take-up cable 43 as the bow is drawn. While draw cable 40 and power cable 42 are received within peripheral grooves of base cam 31 and power cam 32, respectively, lower let-out/take-up cable 43 is not received by a cam at all, but merely wraps around axle 35 and is secures to pulley assembly 30 by post 37. The rate of let-out of lower let-out/take-up cable 43 is not determined by the shape of a cam or pulley, but rather by the position of post 37 relative to axle 35. The use of various shapes, sizes, and mounting positions for base cam 31, power cam 32, and let-out/take-up cam 36 (or even replacement thereof by alternate letting-out and/or taking-up means, as in FIGS. 5A and 5B) to impart various advantageous performance characteristics on a compound bow is well known, and such variations shall fall within the scope of inventive concepts disclosed and/or claimed herein. Such performance characteristics may include, but are not limited to, peak draw weight, draw length, draw weight profile, stored energy, efficiency, arrow speed, let-off, recoil, vibration, noise, nock travel, and so forth.

Figure 6B:
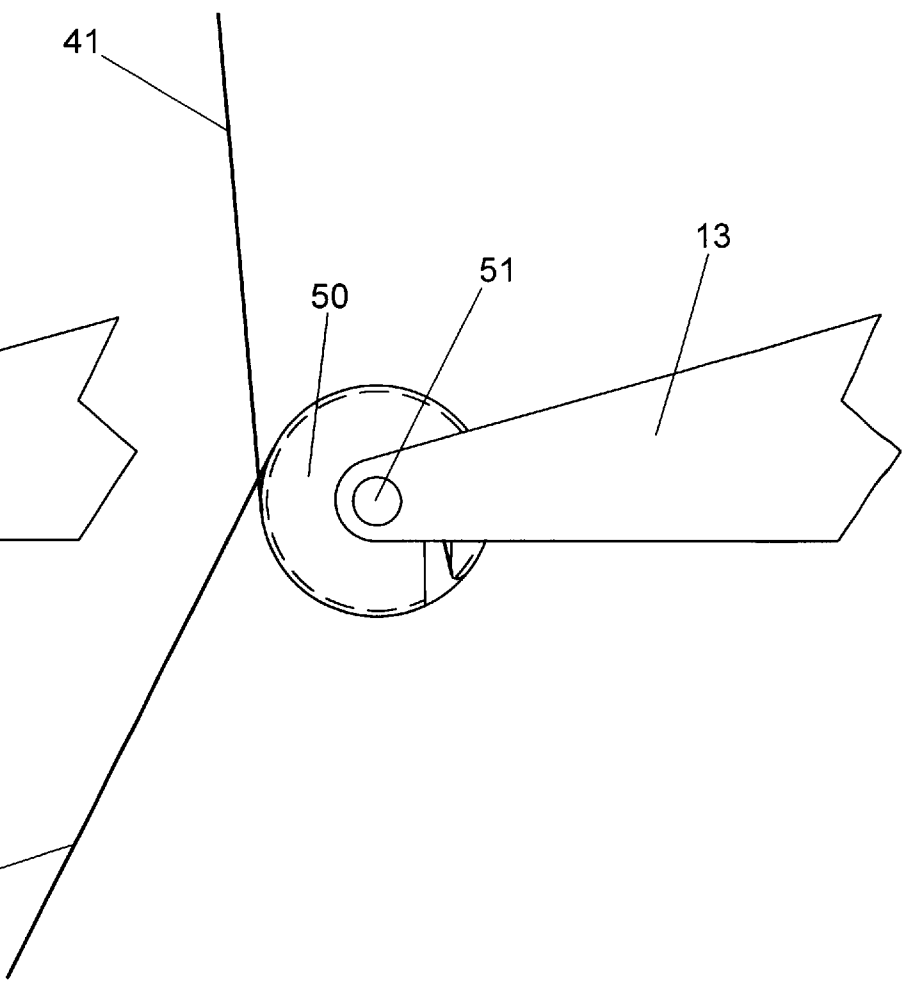
FIGS. 6A and 6B show a force-multiplying middle pulley for a compound archery bow according to the present invention.
Figure 6A:
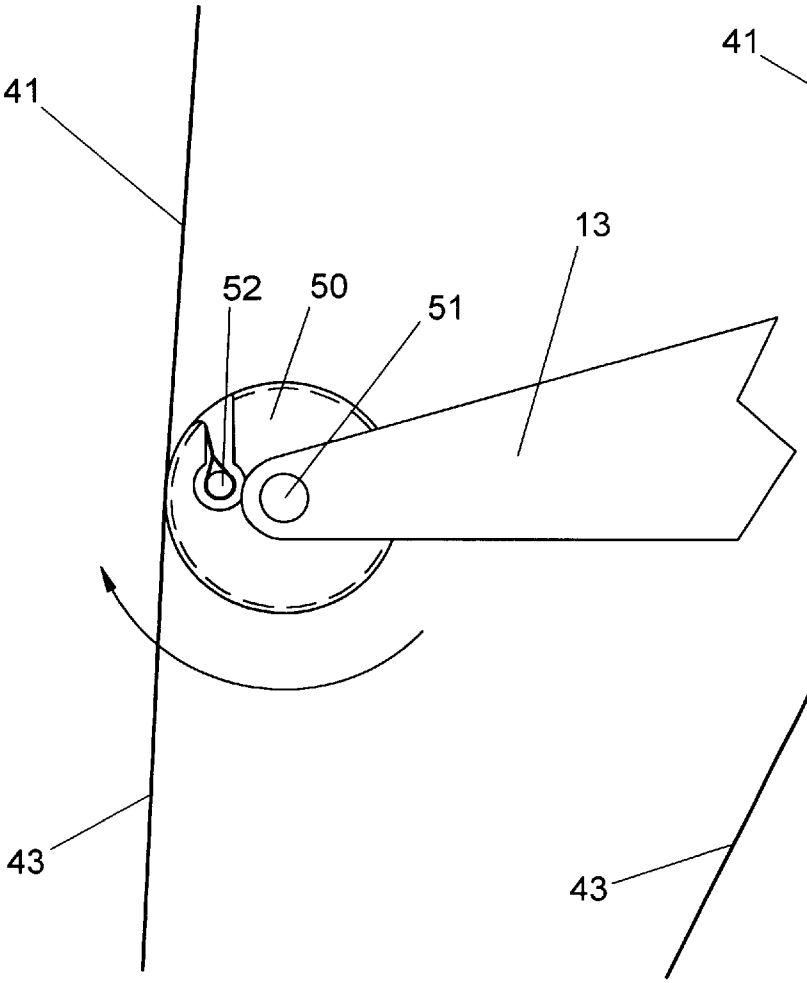
Figure 7C:
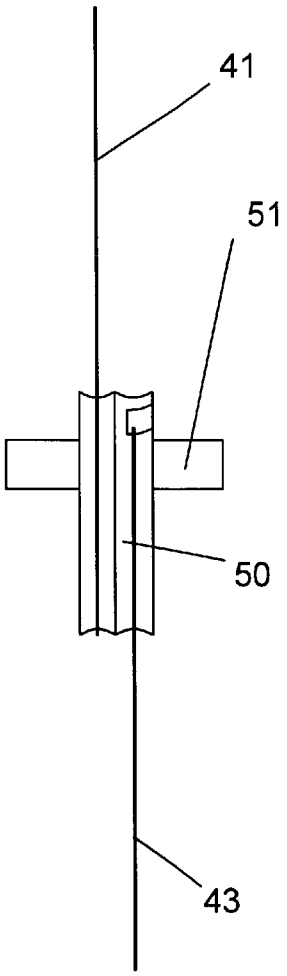
FIGS. 7A, 7B, and 7C show a force-multiplying middle pulley for a compound archery bow according to the present invention.
Figure 7B:
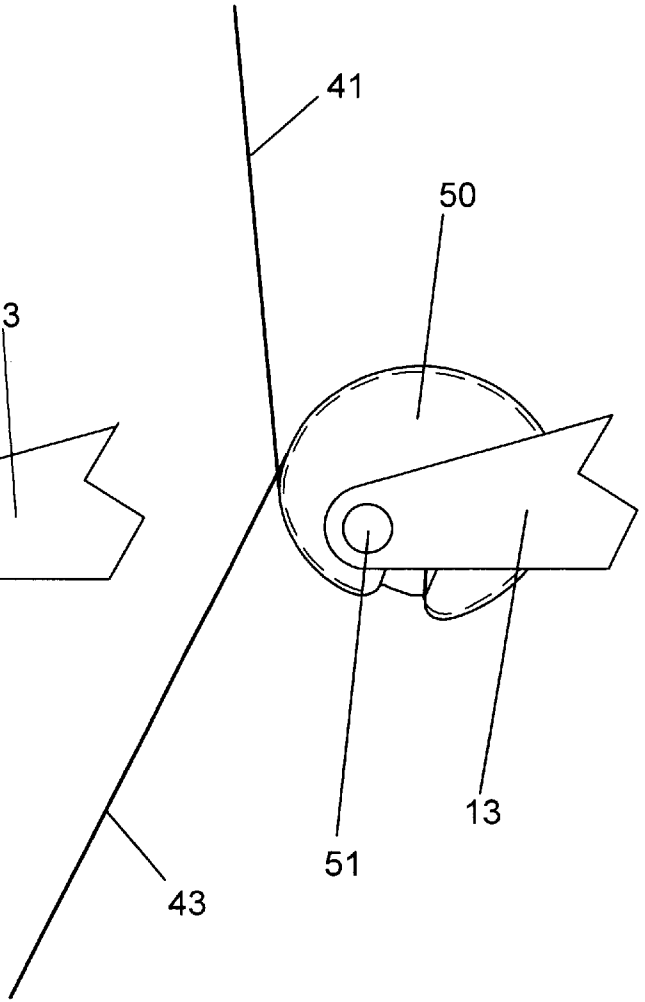
Figure 7A:
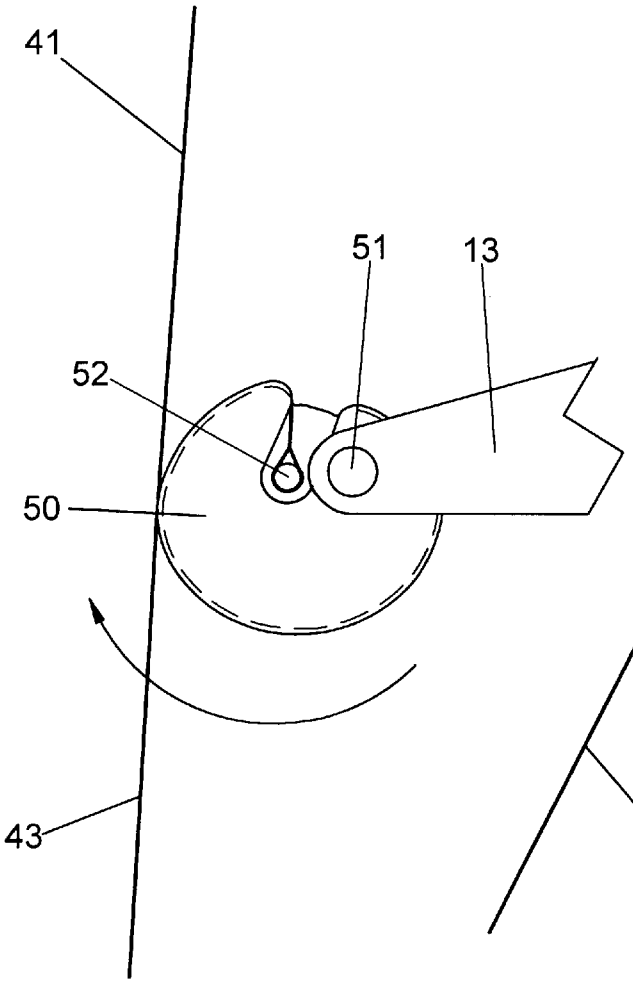
Figure 8B:
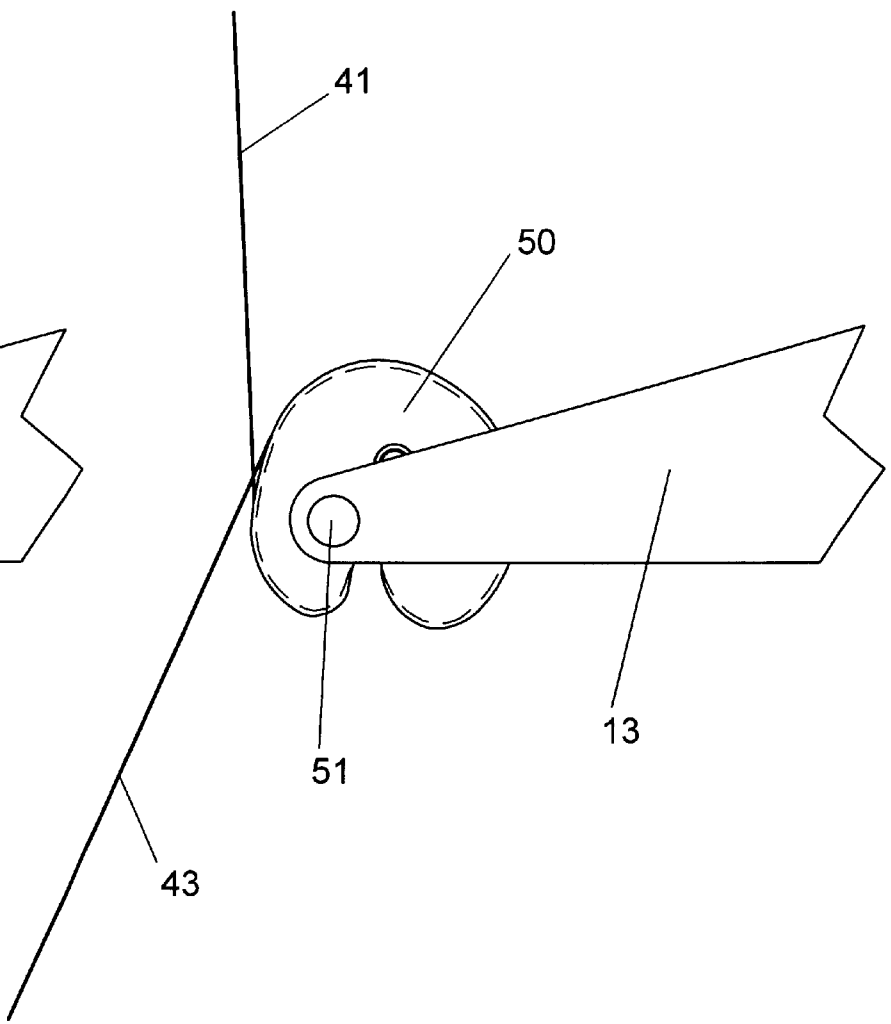
FIGS. 8A and 8B show a force-multiplying middle pulley for a compound archery bow according to the present invention.
Figure 8A:
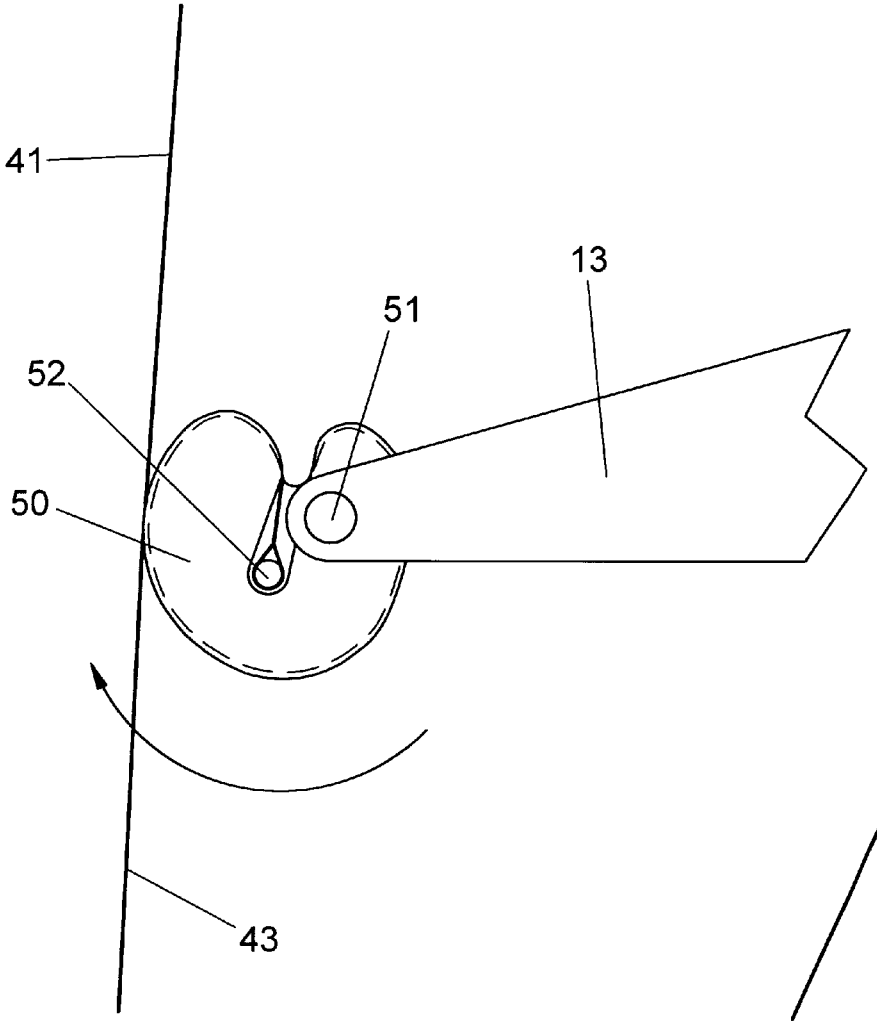

Middle pulley 50, as illustrated in FIGS. 2A–2D, comprises an eccentrically mounted, substantially circular pulley, having one groove for taking up lower let-out/take-up cable 43 and a second groove for letting out upper let-out/take-up cable 41. The position of the eccentrically positioned axle 51 may be varied to achieve various performance characteristics (discussed above) without departing from inventive concepts disclosed and/or claimed herein. In particular, axle 51 may be positioned substantially concentrically on substantially circular pulley 50, as shown in FIGS. 6A and 6B. Likewise, the shape of middle pulley 50 may be varied to achieve various performance characteristics (discussed above) without departing from inventive concepts disclosed and/or claimed herein. FIGS. 7A, 7B, and 7C show an eccentrically mounted, oblong middle pulley that is somewhat wider than it is high, and which exhibits very straight nock travel. FIGS. 8A and 8B show a different oblong, eccentrically mounted middle pulley 50 that is somewhat higher than it is wide, and which exhibits high arrow speeds.

Figure 9B:
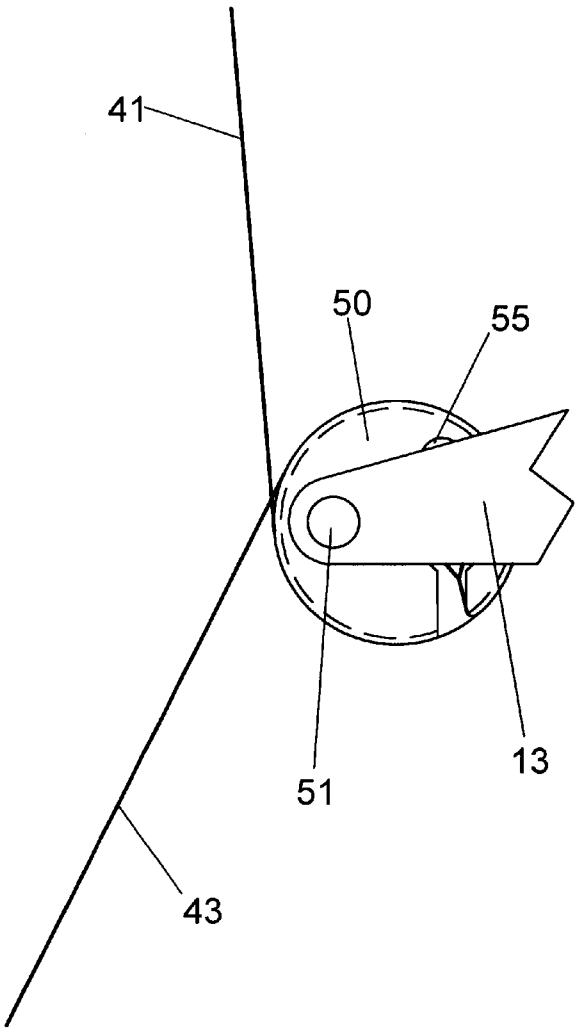
FIGS. 9A and 9B show a force-multiplying middle pulley for a compound archery bow according to the present invention.
Figure 9A:
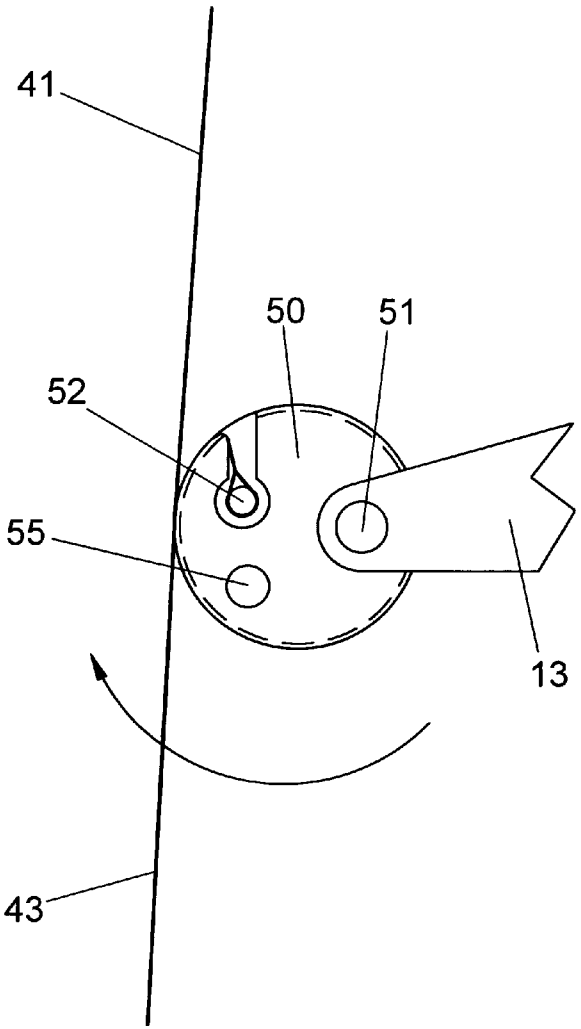

FIGS. 9A and 9B show a middle pulley 50 having an eccentrically mounted weight 55 thereon. The use of such weights on a lower pulley assembly is disclosed in U.S. Pat. No. 5,809,982, said patent being incorporated by reference is if fully set forth herein. The use of such weights on middle pulley 50 may reduce noise, recoil, and/or vibration when the drawn bow is released. The position of the weight (or weights) may be varied to optimize the reduction of vibration, recoil, and/or noise without departing from inventive concepts disclosed and/or claimed herein. A position similar to that shown in FIGS. 9A and 9B, wherein the eccentrically mounted weight 55 is traveling backward and then downward after the drawn bow is released and as the arrow is released, is observed to effectively reduce noise, recoil, and/or vibration when the bow is used to shoot an arrow.

Figure 10C:
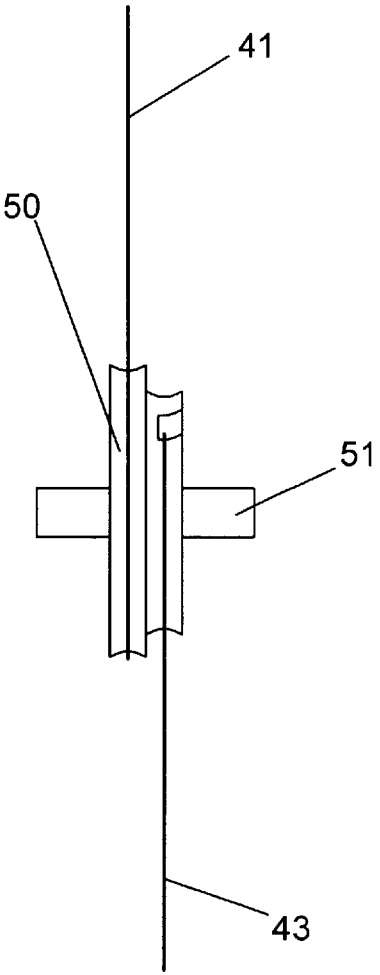
FIGS. 10A, 10B, and 10C show a force-multiplying middle pulley for a compound archery bow according to the present invention.
Figure 10B:
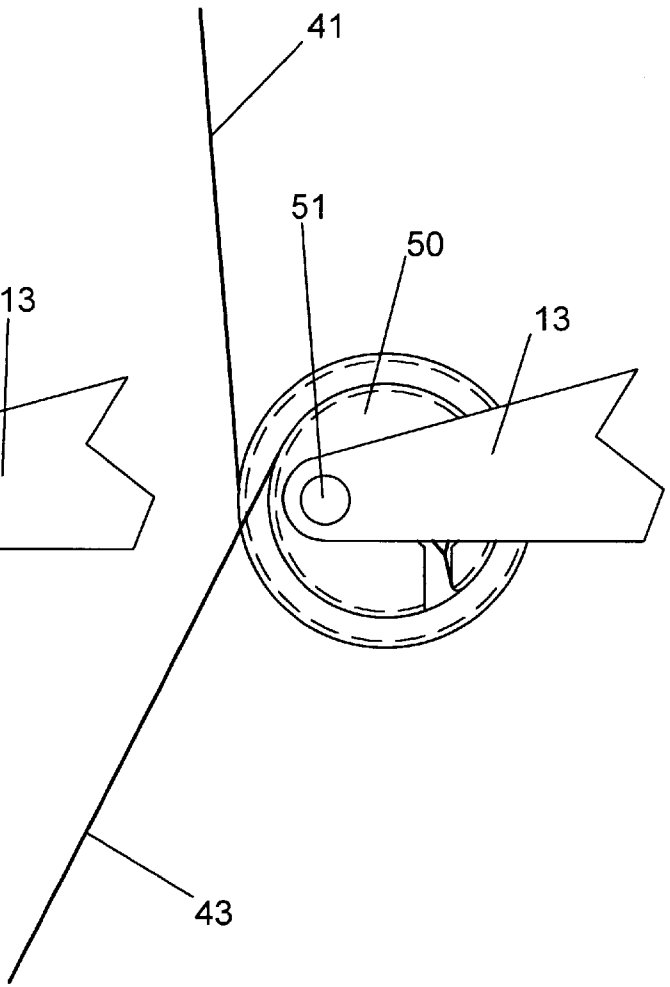
Figure 10A:
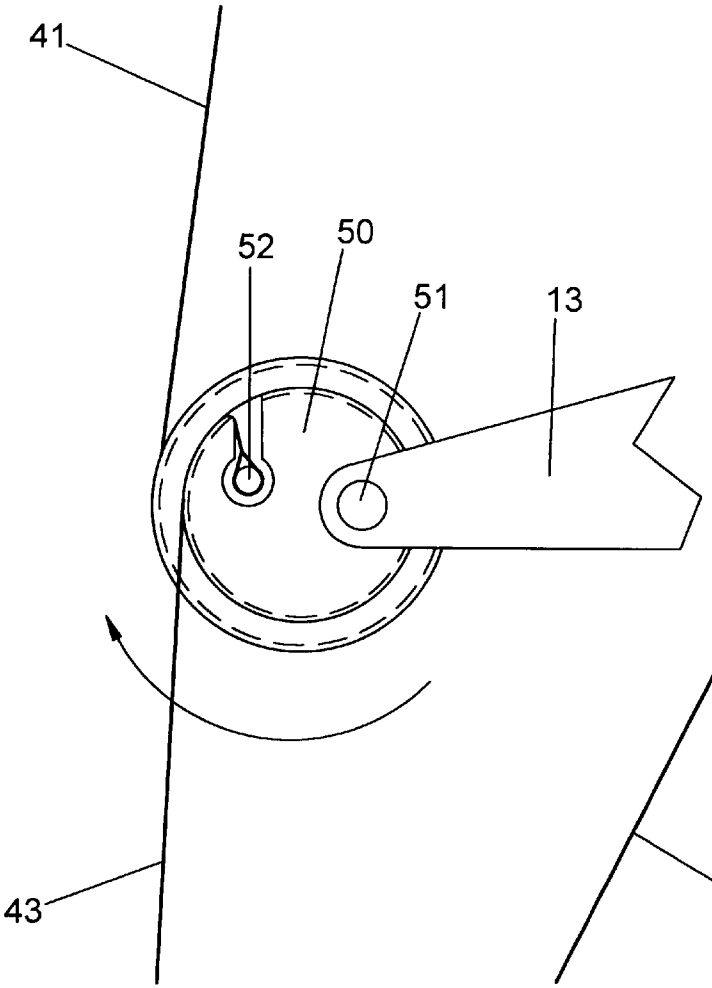
Figure 11C:
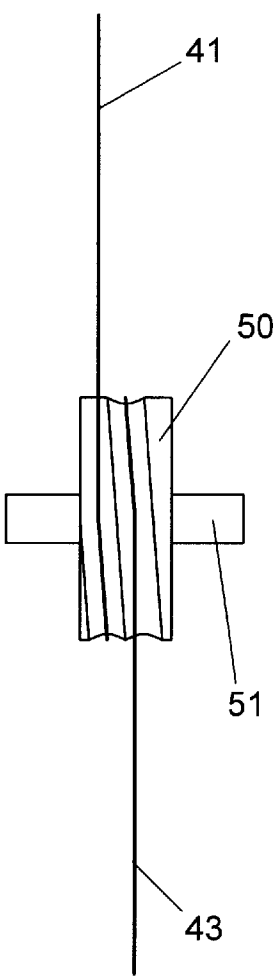
FIGS. 11A, 11B, and 11C show a force-multiplying middle pulley for a compound archery bow according to the present invention.
Figure 11B:
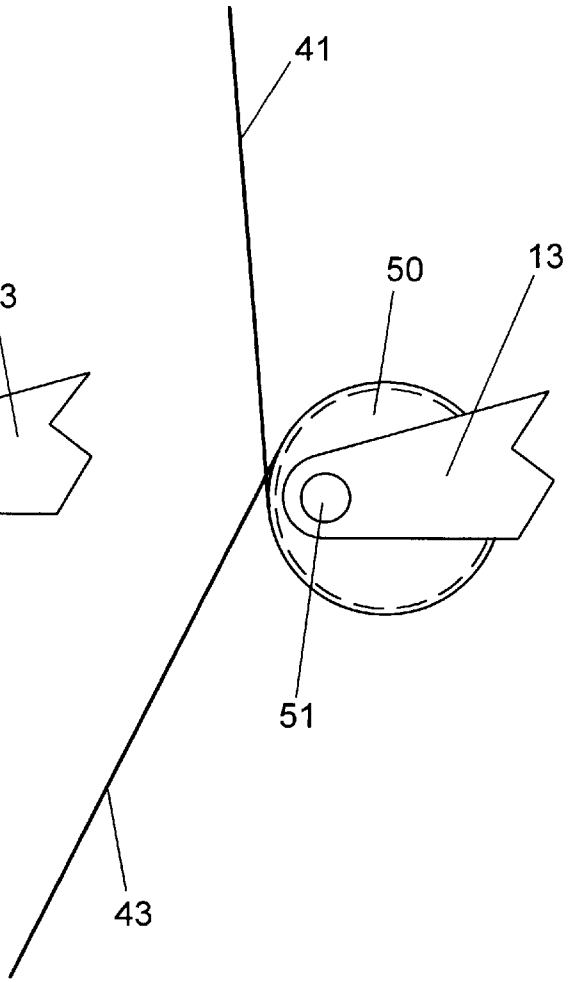
Figure 11A:
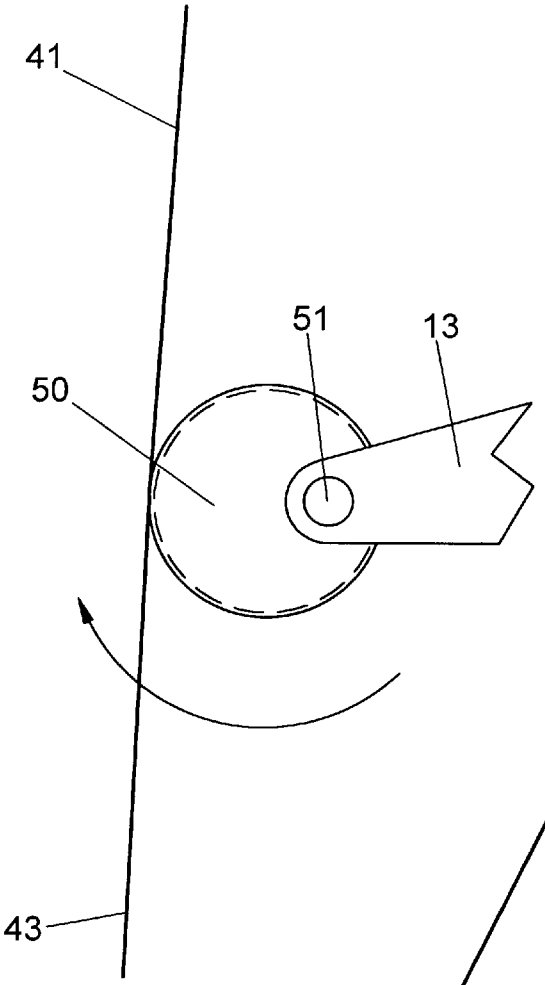

Without departing from inventive concepts disclosed and/or claimed herein, various performance characteristics (as discussed above) of the compound bow may be further varied and/or optimized by providing middle pulley 50 with separate and different (in size and/or shape) peripheral grooves for receiving upper and lower let-out/take-up cables 41 and 43. Such a middle pulley 50 is shown in FIGS. 10A, 10B, and 10C, wherein both tracks are eccentrically mounted and substantially circular, but have different radii. In this example upper let-out/take-up cable 41 would be let out at a faster rate than lower let-out/take-up cable 43 would be taken up. FIGS. 11A, 11B, and 11C show an embodiment wherein a single contiguous cable is used for upper and lower let-out/take-up cables 41 and 43. No mounting post is required on middle pulley 50, and the cable wraps completely around the middle pulley 50.

Figure 12C:
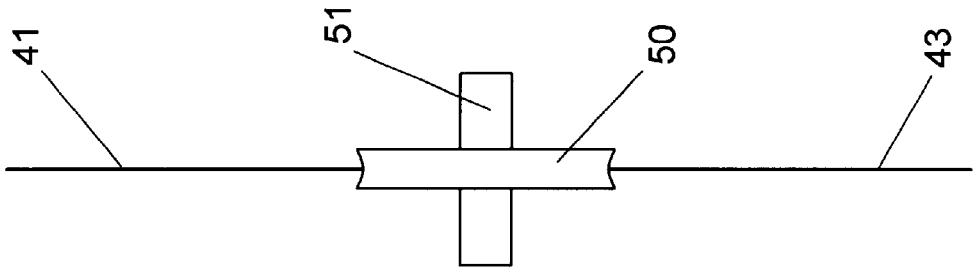
FIGS. 12A, 12B, and 12C show a force-multiplying middle pulley for a compound archery bow according to the present invention.
Figure 12B:
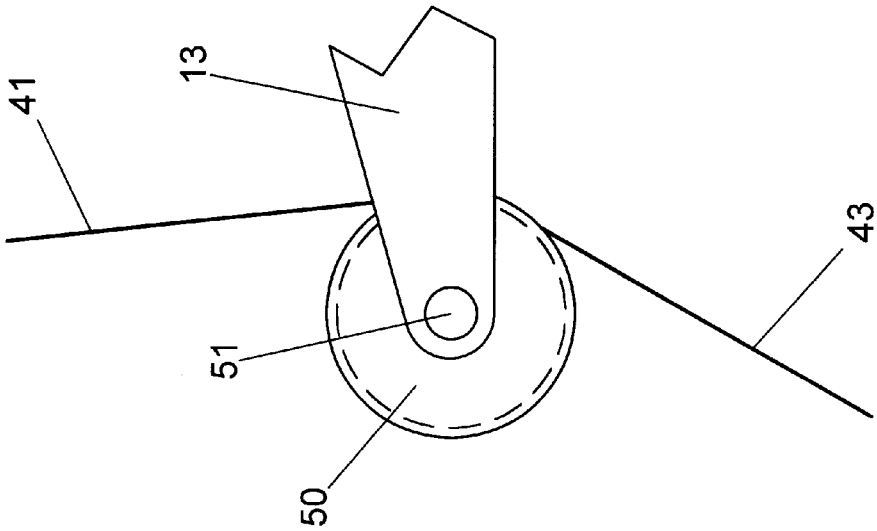
Figure 12A:
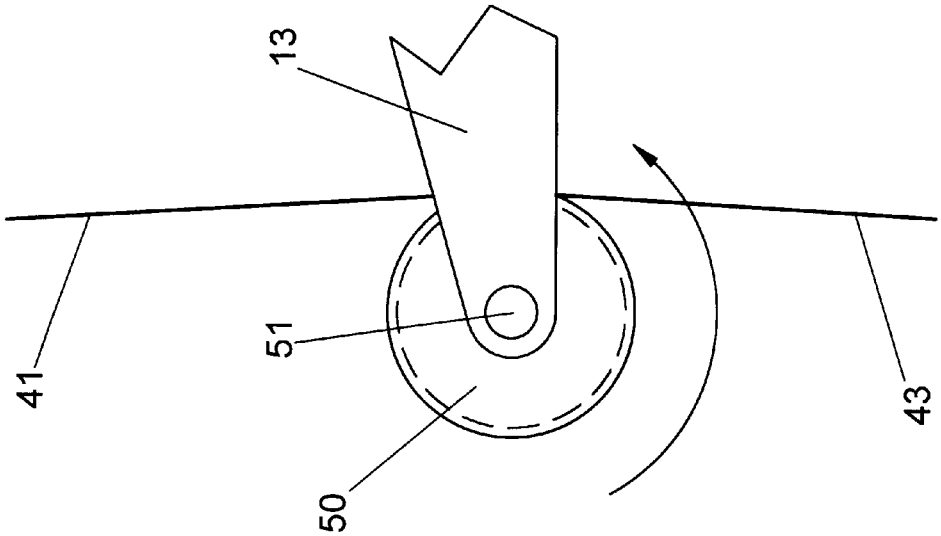
Figure 13C:
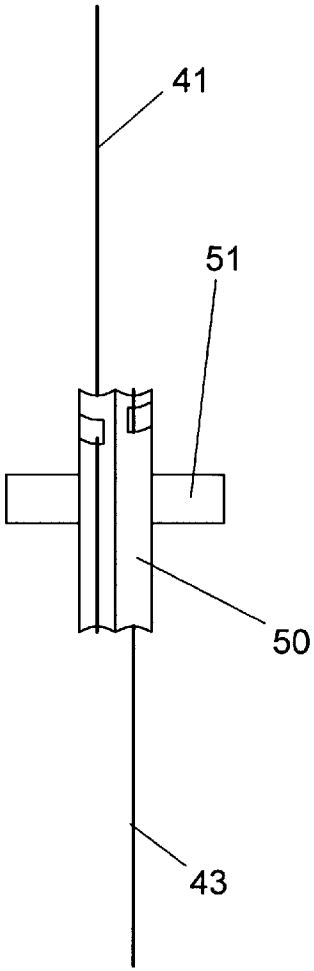
FIGS. 13A, 13B, and 13C show a force-multiplying middle pulley for a compound archery bow according to the present invention.
Figure 13B:
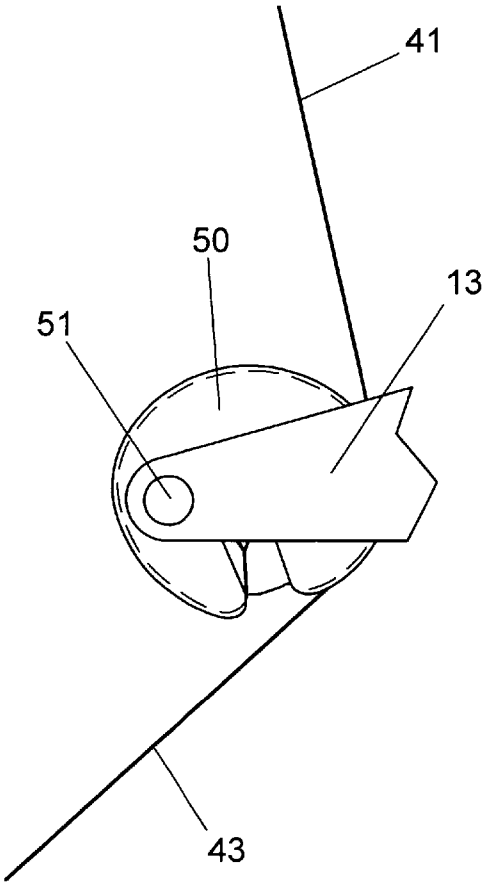
Figure 13A:
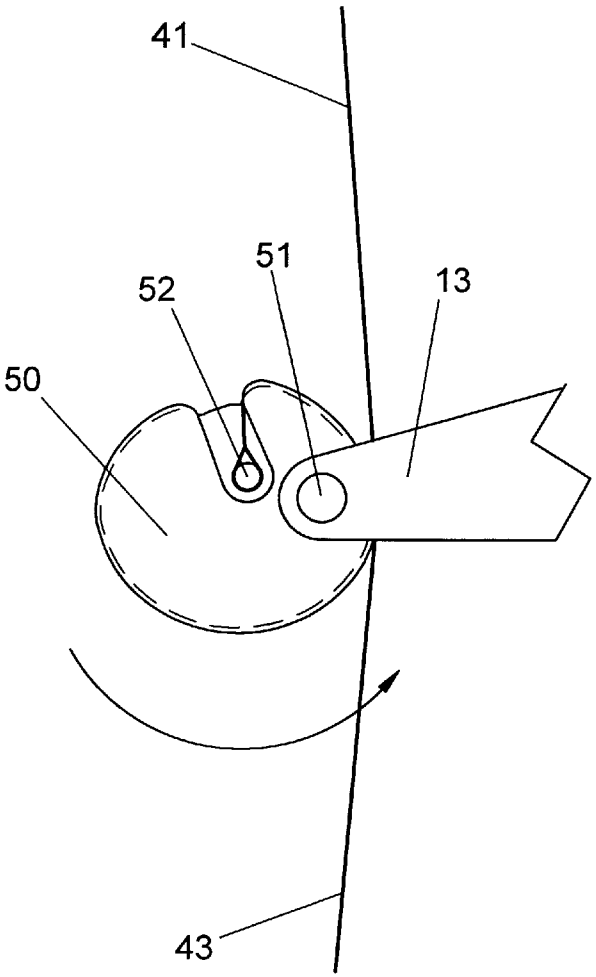
Figure 14C:
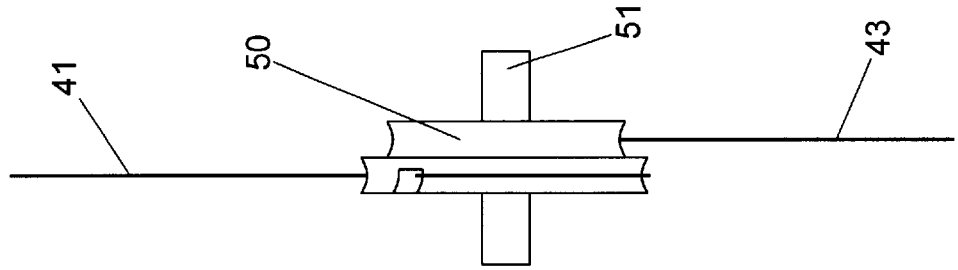
FIGS. 14A, 14B, and 14C show a force-multiplying middle pulley for a compound archery bow according to the present invention.
Figure 14B:
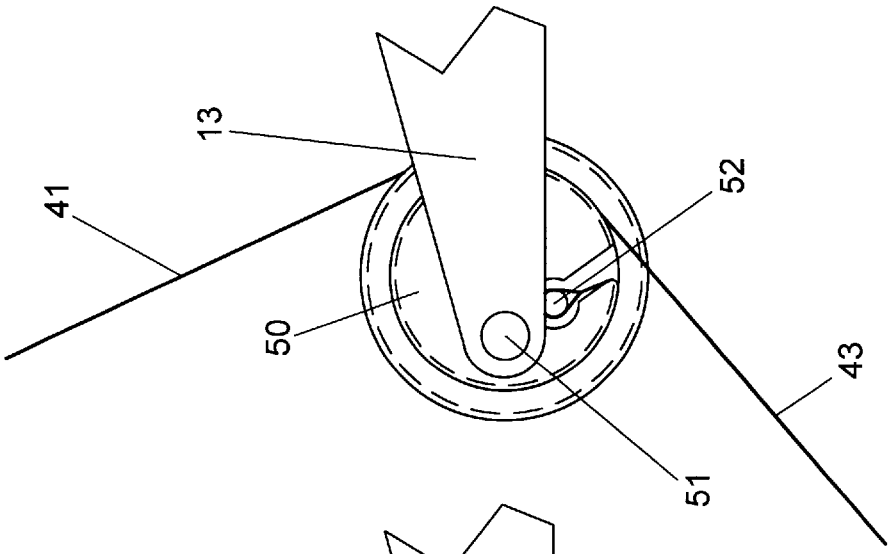
Figure 14A:
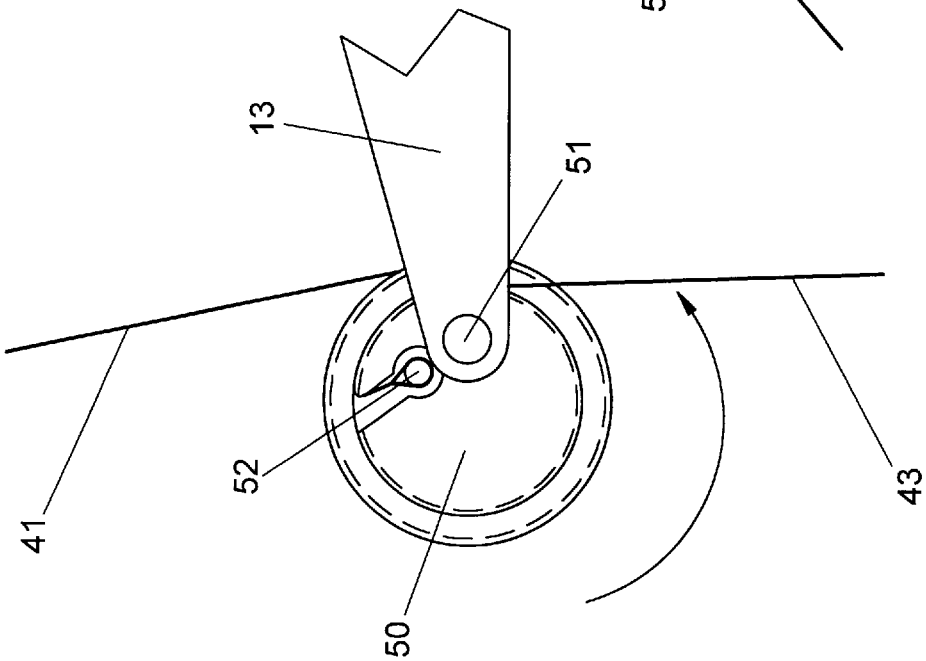
Figures 15A, 15B, 15C, 15D:
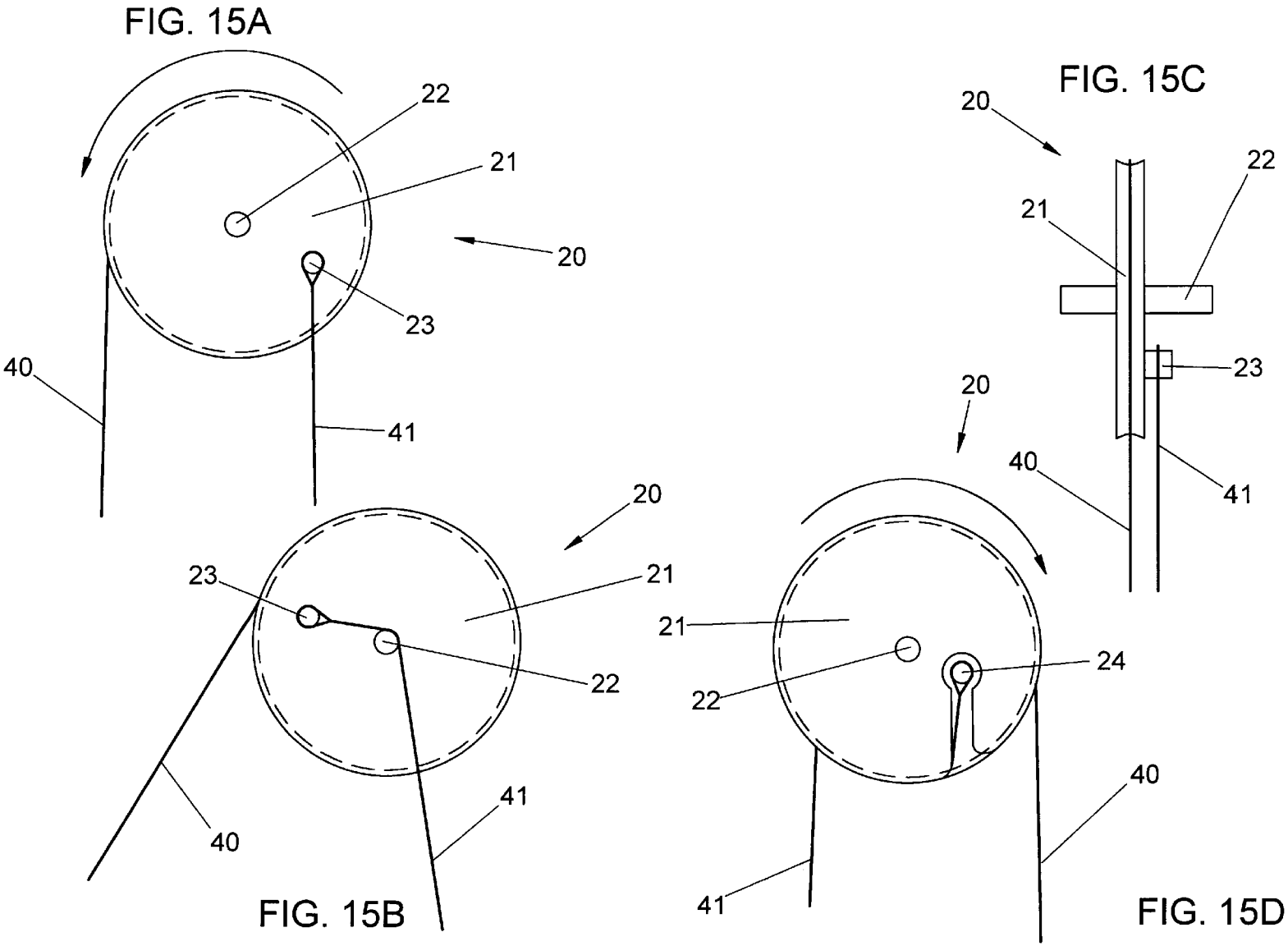
FIGS. 15A, 15B, 15C, and 15D show an upper pulley assembly for a compound archery bow according to the present invention.

All embodiments disclosed to this point have upper and power let-out/take-up cables 41 and 43 passing behind middle pulley 50 with middle pulley 50 rotating clockwise (when viewed from the right side of the bow) when the bow is drawn, and this configuration has been observed to generally produce superior bow performance characteristics. However, without departing from inventive concepts disclosed and/or claimed herein, upper and lower let-out/take-up cables 41 and 43 may pass in front of middle pulley 50, as shown in FIGS. 12A, 12B, and 12C. In this configuration middle pulley 50 rotates in a counter-clockwise direction (when viewed from the right side of the bow) when the bow is drawn. Also, this configuration is amenable to use of a single contiguous cable for upper and lower let-out/take-up cables 41 and 43. A concentrically mounted, substantially circular middle pulley 50 is shown in FIGS. 12A, 12B, and 12C, while an oblong, eccentrically mounted middle pulley 50 is shown in FIGS. 13A, 13B, and 13C, and a middle pulley 50 having different grooves for upper and lower let-out/take-up cables 41 and 43 is shown in FIGS. 14A, 14B, and 14C.

Without departing from inventive concepts disclosed and or claimed herein, various configurations for upper pulley assembly 20 may be employed to achieve various bow performance characteristics (as described above). Upper pulley assembly 20 may comprise a single concentrically mounted, substantially circular wheel 21 having a single groove, and draw cable 40 and upper let-out/take-up cable 41 may form a single contiguous cable which passes over wheel 21. Alternatively, draw cable 40 and upper let-out/take-up cable 41 may be independently secured to upper pulley assembly 20, and may each be received in separate peripheral grooves (which may be differently sized, shaped, and or mounted, or may be substantially similar). A still different configuration for upper pulley assembly 20 is shown in FIGS. 15A, 15B, 15C, and 15D. Draw cable 40 is received within a peripheral groove of pulley 21 and secured to post 24, while upper let-out/take-up cable 41 is secured to post 23, and wraps around axle 22 as pulley 21 rotates counter-clockwise (as viewed from the right side of the bow) as the bow is drawn.

Without departing from inventive concepts disclosed and/or claimed herein, any of the pulleys, cams, and/or pulley assemblies disclosed herein receiving more than one cable may receive more than one cable in a single peripheral groove, rather than receiving each cable in a separate peripheral groove. Without departing from inventive concepts disclosed and/or claimed herein, a curvilinear peripheral groove of a pulley and/or cam for receiving a cable may be replaced by a plurality of posts mounted on the pulley and/or cam that define a path functionally equivalent to that defined by the groove.

The present invention has been set forth in the forms of its preferred and alternative embodiments. It is nevertheless intended that modifications to the disclosed force-multiplying compound archery bow may be made without departing from inventive concepts disclosed and/or claimed herein.

What is claimed is:

1. A compound archery bow, comprising:

a) a central handle portion;

b) oppositely extending upper and lower bow limbs substantially secured to the handle;

c) a draw cable;

d) an upper let-out/take-up cable;

e) a lower let-out/take-up cable;

f) a power cable secured to an upper end of the upper bow limb;

g) an upper pulley assembly rotatably mounted on the upper bow limb at the upper end thereof for letting out an upper end of the draw cable and taking up an upper end of the upper let-out/take-up cable as the bow is drawn;

h) a lower pulley assembly rotatably mounted on the lower bow limb at a lower end thereof and comprising a base cam for letting out a lower end of the draw string as the bow is drawn, let-out/take-up means for letting out a lower end of the lower let-out/take-up cable as the bow is drawn, and a power cam for taking up a lower end of the power cable as the bow is drawn;

i) a bracket substantially secured to the handle; and j) a middle pulley rotatably mounted on the bracket for letting out a lower end of the upper let-out/take-up cable and taking up an upper end of the lower let-out/take-up cable as the bow is drawn.

2. A compound archery bow as recited in claim 1, wherein each of the upper and lower let-out/take-up cables passes behind the middle pulley, and the middle pulley rotates in a clockwise direction as the bow is drawn.

3. A compound archery bow as recited in claim 2, wherein each of the upper and lower let-out/take-up cables are a portion of a single contiguous cable wrapped around the middle pulley.

4. A compound archery bow as recited in claim 2, wherein the middle pulley has a oblong shape.

5. A compound archery bow as recited in claim 4, wherein the middle pulley rotates about an eccentrically positioned rotation axis.

6. A compound archery bow as recited in claim 5, wherein the middle pulley has a first peripheral groove for receiving the upper let-out/take-up cable and a second peripheral groove for receiving the lower let-out/take-up cable, and wherein the first peripheral groove and the second peripheral groove are substantially the same size and have substantially the same shape.

7. A compound archery bow as recited in claim 2, wherein the middle pulley has a first peripheral groove for receiving the upper let-out/take-up cable, and a second peripheral groove for receiving the lower let-out/take-up cable.

8. A compound archery bow as recited in claim 7, wherein the first peripheral groove and the second peripheral groove are substantially the same size and have substantially the same shape.

9. A compound archery bow as recited in claim 7, wherein the first peripheral groove differs from the second peripheral groove with respect to at least one of size and shape.

10. A compound archery bow as recited in claim 2, wherein the middle pulley is substantially circular.

11. A compound archery bow as recited in claim 10, wherein the middle pulley rotates about a substantially concentrically positioned rotation axis.

12. A compound archery bow as recited in claim 10, wherein the middle pulley rotates about an eccentrically positioned rotation axis.

13. A compound archery bow as recited in claim 2, wherein the middle pulley is provided with an eccentrically positioned weight.

14. A compound archery bow as recited in claim 1, wherein each of the upper and lower let-out/take-up cables passes in front of the middle pulley, and the middle pulley rotates in a counter-clockwise direction as the bow is drawn.

15. A compound archery bow as recited in claim 14, wherein each of the upper and lower let-out/take-up cables are a portion of a single contiguous cable.

16. A compound archery bow as recited in claim 14, wherein the middle pulley has a oblong shape.

17. A compound archery bow as recited in claim 16, wherein the middle pulley rotates about an eccentrically positioned rotation axis.

18. A compound archery bow as recited in claim 17, wherein the middle pulley has a first peripheral groove for receiving the upper let-out/take-up cable and a second peripheral groove for receiving the lower let-out/take-up cable, and wherein the first peripheral groove and the second peripheral groove are substantially the same size and have substantially the same shape.

19. A compound archery bow as recited in claim 14, wherein the middle pulley has a first peripheral groove for receiving the upper let-out/take-up cable, and a second peripheral groove for receiving the lower let-out/take-up cable.

20. A compound archery bow as recited in claim 19, wherein the first peripheral groove and the second peripheral groove are substantially the same size and have substantially the same shape.

21. A compound archery bow as recited in claim 19, wherein the first peripheral groove differs from the second peripheral groove with respect to at least one of size and shape.

22. A compound archery bow as recited in claim 14, wherein the middle pulley is substantially circular.

23. A compound archery bow as recited in claim 22, wherein the middle pulley rotates about a substantially concentrically positioned rotation axis.

24. A compound archery bow as recited in claim 22, wherein the middle pulley rotates about an eccentrically positioned rotation axis.

25. A compound archery bow as recited in claim 14, wherein the middle pulley is provided with an eccentrically positioned weight.

* * * * *